US005632390A

United States Patent [19]

Podergois

[11] Patent Number: 5,632,390

[45] Date of Patent: May 27, 1997

[54] FOLDABLE DISPLAY ASSEMBLY

[76] Inventor: Jeffrey A. Podergois, 1031 Saddlebrook Trail, Chanhassen, Minn. 55317

[21] Appl. No.: 577,709

[22] Filed: Dec. 22, 1995

[51] Int. Cl.[6] ..... A47F 5/00

[52] U.S. Cl. ..... 211/195; 211/149; 248/174; 40/605; 40/610

[58] Field of Search ..... 211/195, 149, 211/132; 248/174; 40/610, 539, 605

[56] References Cited

U.S. PATENT DOCUMENTS

| | | | |
|---|---|---|---|
| 1,852,471 | 4/1932 | Nelson | 211/149 X |
| 2,049,231 | 7/1936 | Storch | 248/174 |
| 2,373,778 | 4/1945 | Quinby | 40/605 |
| 2,824,395 | 2/1958 | Decker et al. | 40/610 X |
| 3,113,392 | 12/1963 | Downing | 211/195 X |
| 3,559,814 | 2/1971 | Downing | 211/149 X |
| 3,601,916 | 8/1971 | Epstein | 40/605 |
| 3,987,737 | 10/1976 | Smith | 211/149 X |
| 4,068,398 | 1/1978 | Parisi | 40/610 X |
| 4,319,688 | 3/1982 | Wahl | 40/610 X |
| 4,428,136 | 1/1984 | Franklin | 40/539 X |
| 4,655,352 | 4/1987 | Noyes et al. | 40/605 X |
| 5,483,779 | 1/1996 | Crawford et al. | 40/610 X |

*Primary Examiner*—Robert W. Gibson, Jr.
*Attorney, Agent, or Firm*—Malcolm Reid

[57] ABSTRACT

A display assembly constructed of corrugated paperboard comprising two triangular vertical end columns with a center wall supported therebetween for affixing materials to be displayed and a header member affixed to the top of the two end columns and extending therebetween to provide lateral stability and serve as an additional display area. The display is manufactured to be delivered to the user in a flat knocked-down folded condition. The display is designed to be easily assembled by the user at the point of use without any tools or connectors other than those that are a part of and integral to the corrugated panels which are assembled to form the display.

22 Claims, 20 Drawing Sheets

FOLDABLE DISPLAY ASSEMBLY

FIELD OF THE INVENTION

The invention relates generally to foldable display assemblies and more particularly to lightweight portable display assemblies constructed of a corrugated paper product.

BACKGROUND OF THE INVENTION

Trade shows are an increasingly used means for vendors of products to advertise their goods and services to the trade. These shows are held worldwide and attract vendors, buyers, and resellers from far flung geographic areas. Large sums of money are spent by vendors to display their products in an eye catching manner. Generally, the vendor either purchases or makes a display assembly and ships it to the trade show where it is assembled. After the show the display is disassembled and shipped back to the vendor's place of business where it is stored until the next trade show. It is not uncommon for a vendor to attend multiple trade shows annually.

The display assemblies commonly available are expensive to purchase or construct, ship, assemble, disassemble, and store. The expense associated with them is due to their weight and large unwieldly size, and the materials from which they are constructed. Generally, displays are constructed of heavy hard to work materials such as wood and metal. They are fastened together with common fasteners such as screws staples, pins, and metal rods. The displays are knocked down for shipment to the trade show location and often require skilled labor to assemble. Some trade show displays may be knocked down for shipment as luggage, but they generally must be shipped in multiple packages due to the fact that they consist of a sheet material and a separate frame structure. The bulky frame structure alone may require shipment in multiple packages.

It is an object of the present invention to provide an attractive, lightweight, and portable display assembly constructed of heavy duty corrugated paper board.

It is another object to provide a low cost display assembly that can be disposed of or re-used should the user so choose.

It is a further object to provide a display assembly that is easily and quickly assembled by the user without tools.

It is yet another object to provide a display which is assembled by the user only with fasteners or connectors integral to and a part of the corrugated paper structure members of the display assembly.

It is an object of the present invention to construct a display unit of easy to connect sections using a butted joint design for an attractive and clean look.

It is an object to construct a display assembly having a center wall, two end columns supporting the center wall, and a header.

A further object of the present invention is to provide a display assembly that can be shipped in a small compact point of sale container and is lightweight when packed for shipment.

It is a further object of the present invention to provide a display assembly that is strong and rigid and yet be free-standing without any additional support members.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particulary pointed out in the appended claims.

SUMMARY OF THE INVENTION

The present invention provides an improvement in the presently available display asssemblies. It comprises two triangular shaped end columns which support a center wall centrally disposed between the end columns. The center wall is engaged along its vertical edges with each of the end columns by tabs extending from each vertical edge of the center wall and inserted into corresponding slots on the end walls in a locking arrangement. The locking slot and tab arrangement provide a butted joint between the end columns and the center wall, which provide a strong and rigid interlock between the center wall and the end columns as well as providing vertical stability of the entire display assembly.

Further locking engagement of the center wall between the two end columns is provided by a header member that extends between the end columns. The header locks into each column by the engagement of a slot on the header with the top of a vertical wall of each column.

The display is constructed of paper board or cardboard as it is generally referred to. The cardboard allows the display to be made light weight and to be of modular construction. It also allows the parts of the display to be folded and packed flat in a small easily portable point of sale container. The point of sale container may be inexpensively shipped and stored. The cardboard material has the advantage of being inexpensively die cut and creased.

The interconnection of the parts of the display is accomplished entirely by insertion of die cut tabs and slots. No other fasteners are required. Strength and rigidity of the display is also entirely a function of the folding and interlocking of the parts of the display. No other materials are used to acomplish this purpose. Creasing of the cardboard to form fold lines during manufacture of the cardboard display parts allows for straight and properly aligned folds during assembly.

Triangular construction of the end columns and overlapping of the cardboard with mating tabs and slots provides strength and stability to these support columns. The center wall is strengthened by horizontal and vertical ribs formed by folding the cardboard centerwall section along preformed fold lines. Added rigidity and an aesthetic look is provided by a header attached horizontally from the top of a first end column extending to the top of a second end column.

The front of the display is laminated with fabric-like textures to provide a professional appearance. The entire display may also be sprayed during manufacture with a fire retardant coating.

The entire display assembly is packed in a point of sale container in a knocked down flat condition.

BRIEF DESCRIPTION OF THE DRAWINGS

The accompanying drawings incorporated in and forming a part of the specification illustrate several aspects of the present invention, and, together with the description, serve to explain the principles of the invention. In the drawings:

FIG. 7A shows an end column partially unfolded after taking it out of the point of sale container. FIGS. 7B and 7C show two stages of assembly of an end column.

DETAILED DESCRIPTION OF THE PREFERRED EMBODIMENT

Figure 1:
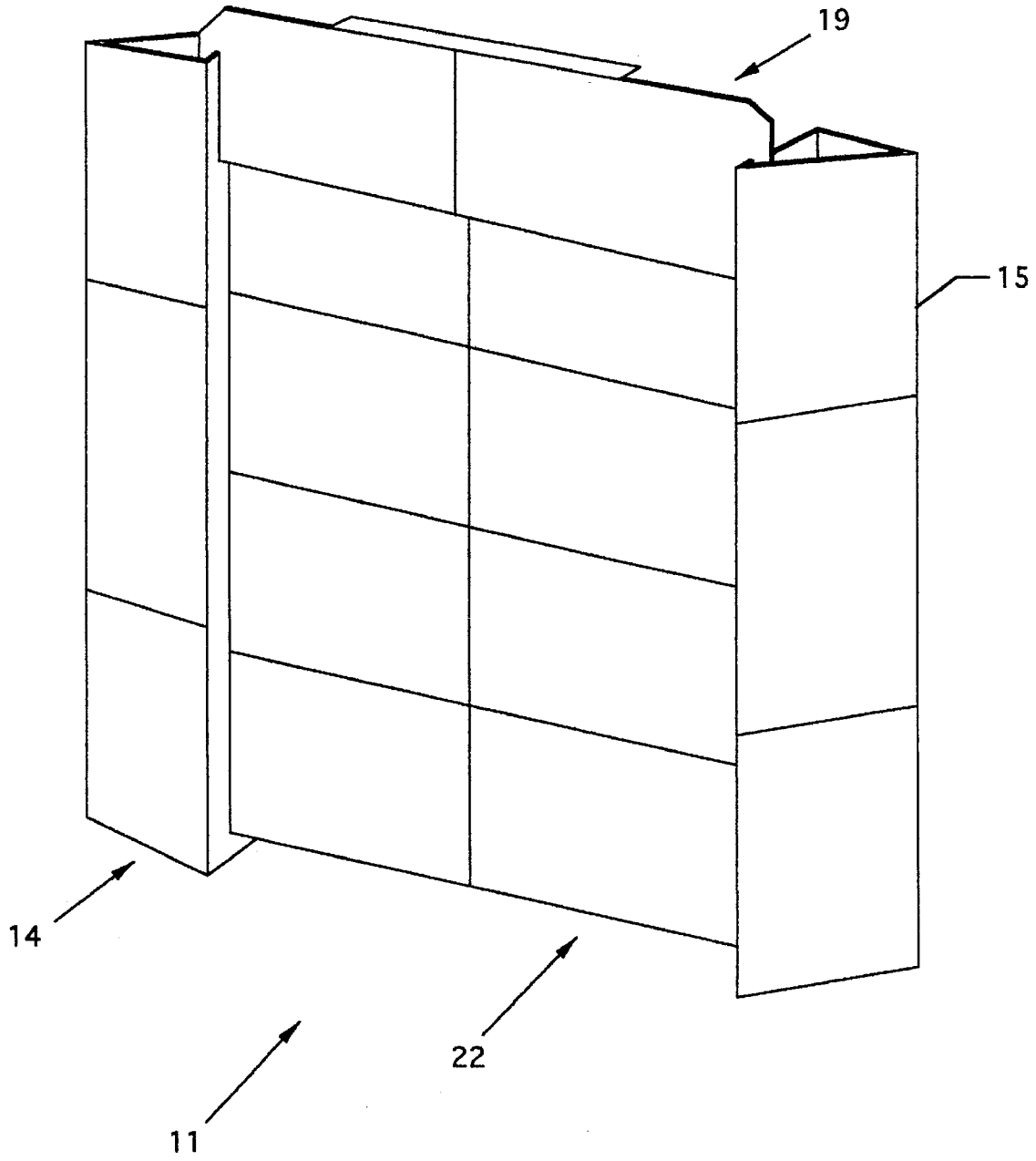
FIG. 1 is a perspective view of the front of the display assembly.

Referring now to the drawings, FIG. 1 depicts the front of my fully assembled portable knock-down display assembly ready to provide a background display at sales meetings, conventions, trade shows, and the like. The display assembly is constructed in accordance with the principles of the present invention and is generally designated by the numeral 11. Display assembly 11 comprises upstanding, laterally spaced apart, triangular first end column and second end column 14 and 15. The end columns stabilize the display assembly 11 and support between them a center wall 22 with a front face, as shown in FIG. 1, attractively laminated with a fabric-like finish to give the display a professional look associated with more expensive displays. The center wall is the primary viewing area for displayed materials. The front facing side, which is disposed at an angle to the center wall 22, of the end columns 14 and 15 also serves as a display area. This area is viewable as the display is approached from the side such as is often the case at trade shows where displays are arranged in rows. Also supported between the end columns 14 and 15 is a header 19, providing further lateral support as well as a viewing area for displayed materials. Both the center wall 22 and the header 19 form the frontal viewing surface of the display 11. Like the center wall 22, the end columns and the header are laminated with a fabric-like finish.

Signs or other items to be displayed may be mounted on the display assembly with any traditional method, such as two way tape, Velcro, pins, or removable adhesive.

Figure 2:
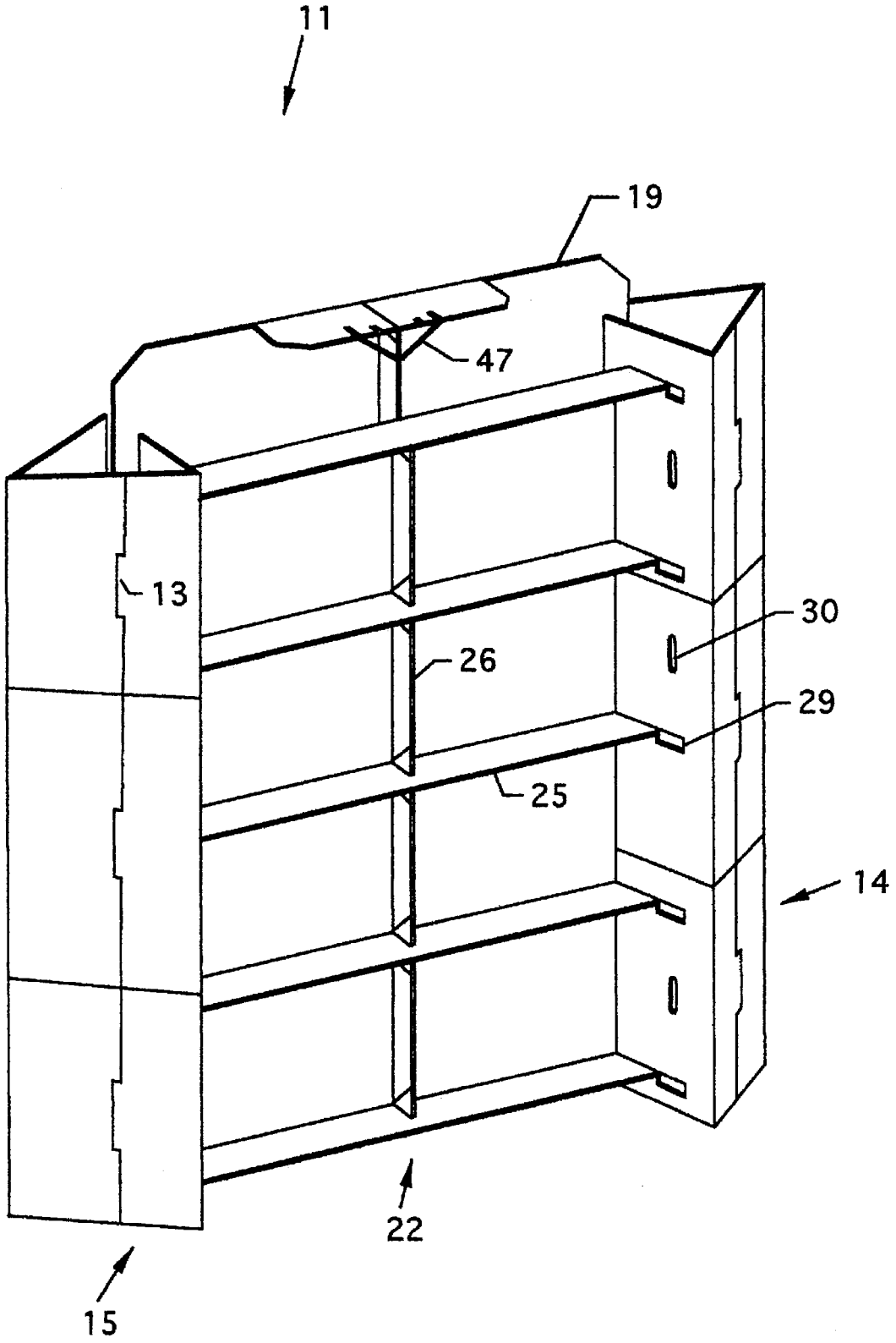
FIG. 2 is a perspective view of the back of the display assembly.
Figure 11:
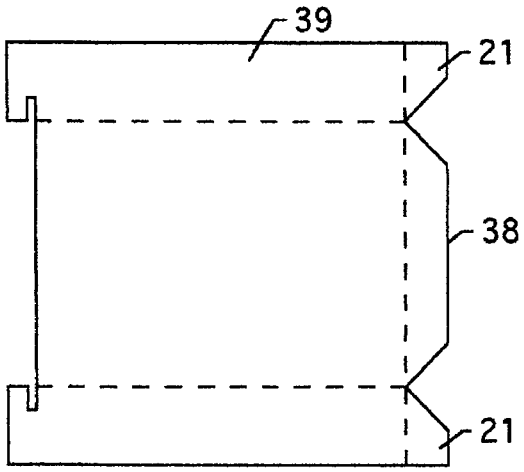
FIG. 11 is a plan view of a center wall section panel.
Figure 12:
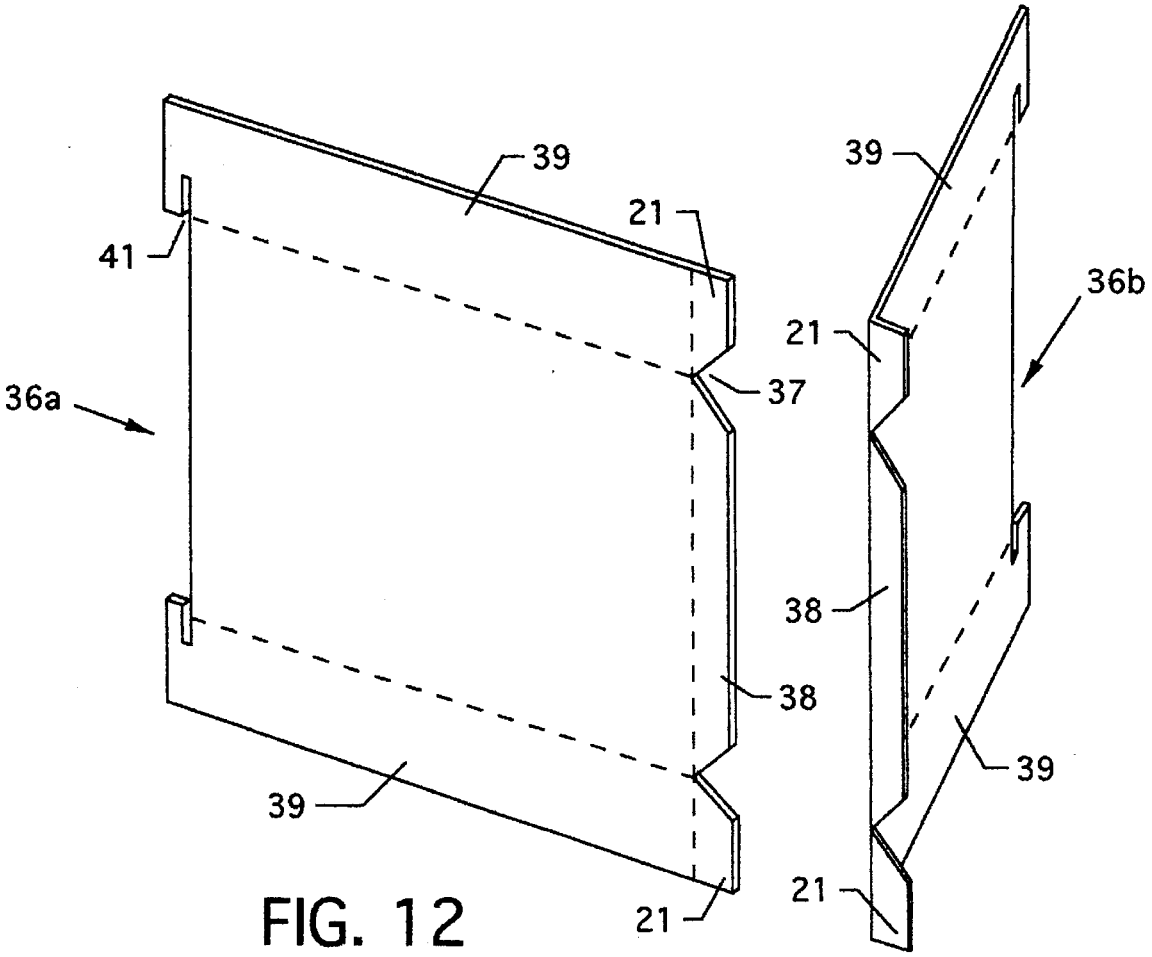
FIG. 12 is a perspective view of the back of a center wall section in a partially unfolded state.
Figure 14:
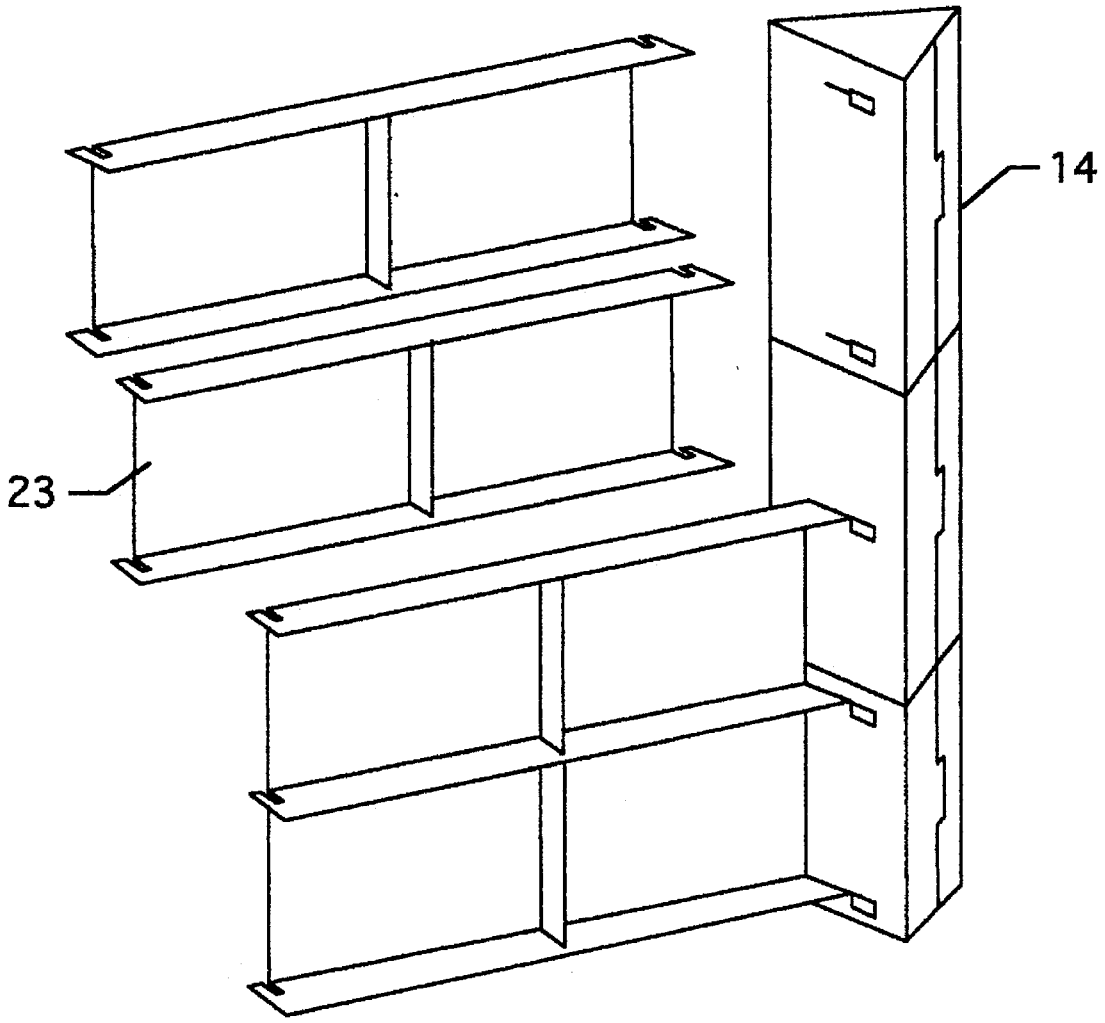
FIG. 14 is a perspective view from the back of the display assembly showing assembly of the four center wall sections to an end column.

FIG. 2 shows the back of the display assembly 11 illustrating, among other features of the display assembly, the center wall vertical and horizontal cardboard reinforcing ribs 26 and 25, respectively. Vertical ribs 26 and 25 and horizontal rib stops 21 are formed by folding the knocked-down center wall section panels 36*a* and 36*b*, as shown in FIGS. 11 and 12, along crease lines formed during manufacture of the die cut cardboard sections. Crease lines are shown throughout the drawings as dotted lines and are not numbered. In the case of the vertical rib 26, the center wall vertical rib tabs 38 and the horizontal rib stops 21 are folded at right angles to the center wall section panels 36*a* and 36*b*and the opposing center wall vertical rib tabs 38 and the horizontal rib stops 21 are glued together to form the center wall vertical rib 26 and a center wall section 23. The horizontal rib tabs 39 are then folded at right angles to the center wall section panels 36*a* and 36*b* to form a center wall horizontal rib 25. The center wall horizontal ribs 25 are reinforced between center wall sections 23 by the placement of the horizontal ribs 25 of adjacent center wall sections 23 in contact with one another, as shown in FIG. 14, thereby doubling the strength of the horizontal rib 25 between center wall sections 23.

As previously stated each of the end columns 14 and 15, the center wall sections 23, and the header 19 are die cut from rigid corrugated paper, thereby providing strength to the assembled display 11.

Figure 3A:
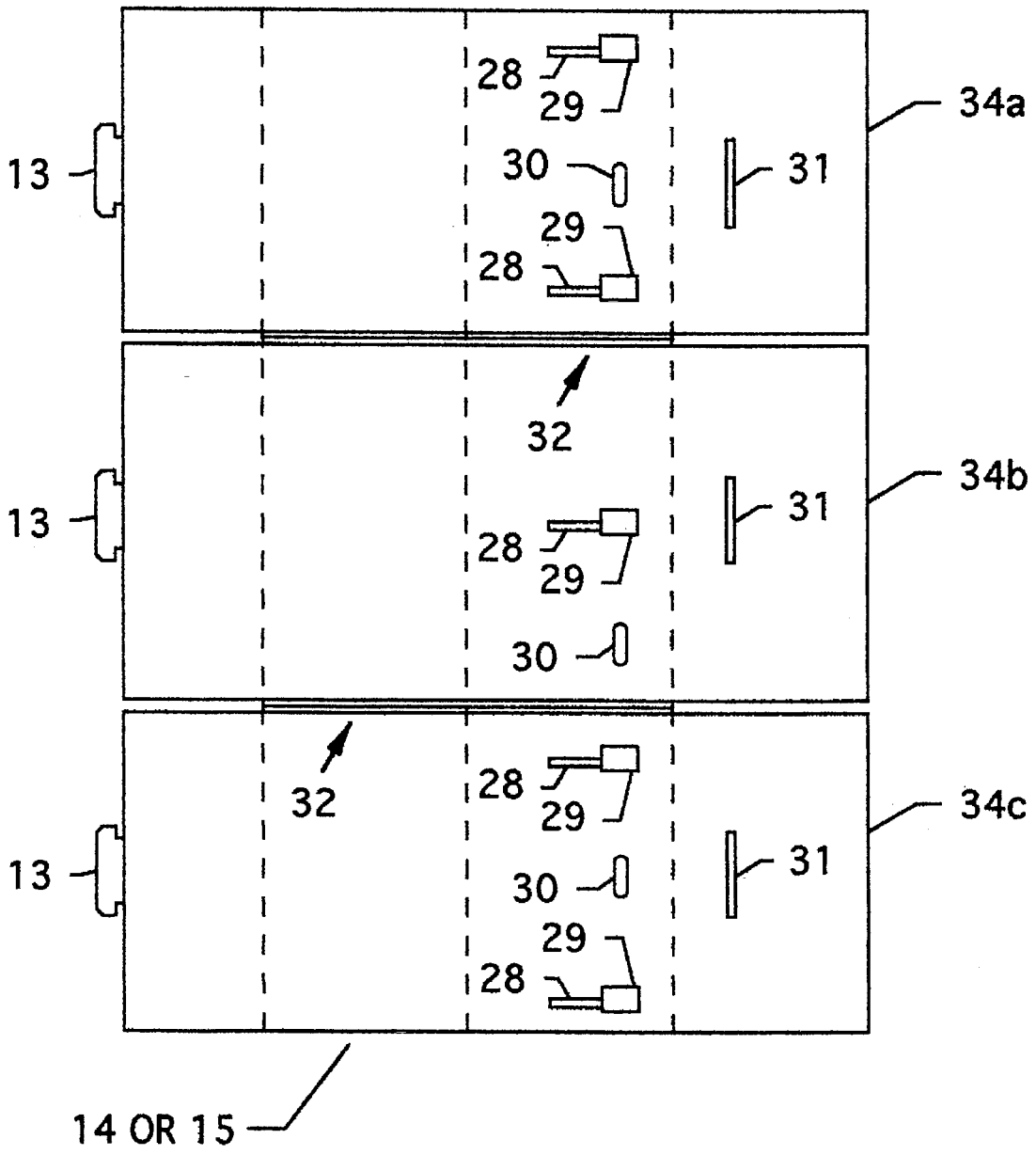
FIG. 3A is a plan view of an unassembled end column.
Figure 3B:
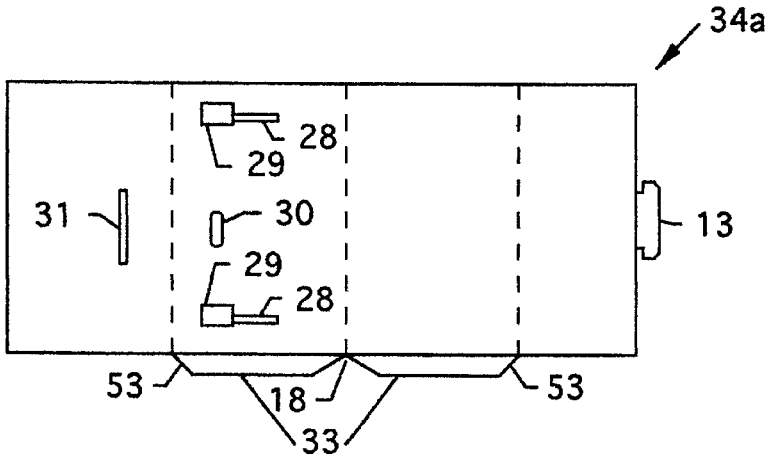
FIG. 3B is a plan view of a first panel of an unassembled end column.
Figure 3C:
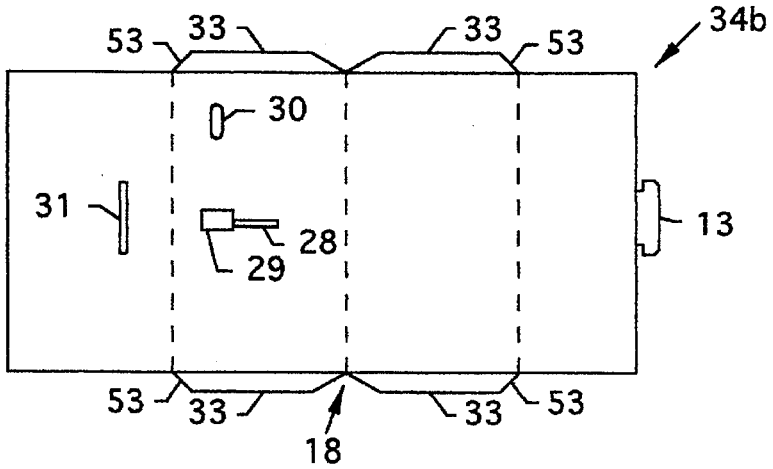
FIG. 3C is a plan view of a second panel of an unassembled end column.
Figure 3D:
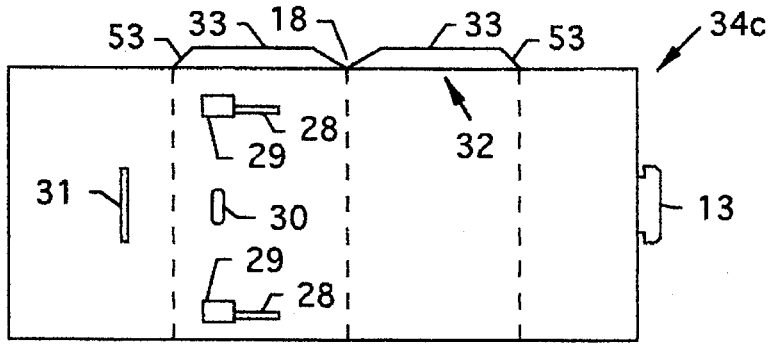
FIG. 3D is a plan view of a third panel of an unassembled end column.
Figure 10:
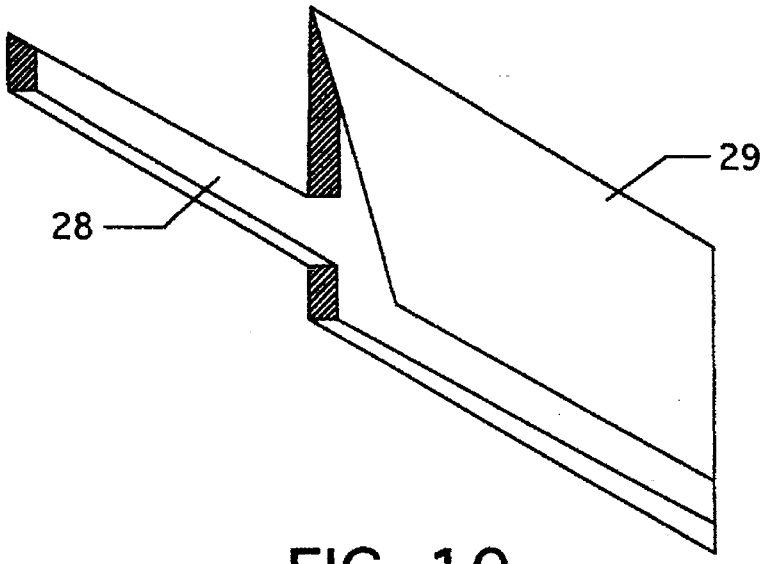
FIG. 10 is an elevational view showing a locking door and center wall slot in an end column.

FIGS. 3B through 3D illustrates the three segments of an end column in an unfolded flat condition as it is after being die cut. Each end column has integrally connected tabs 13 for mating engagement with corresponding end column slots 31. Each end column, 14 and 15, has five center wall slots 28 each adjacent and in communication with its respective locking door 29. Locking door 29 is shown in detail in FIG. 10. The locking door 29 is a square or rectangular shape having three sides slit through the corrugated paper end column. The top of the locking door 29 is creased during manufacture so that it easily folds into the end column 14 and 15 center. Due to the nature of the corrugated material, the locking door 29 springs back to its original flush position with the end column 14 and 15 wall when the force depressing it inward is released, thereby locking the center section end tabs 52 into the end column slots 31 during assembly of the display 11 by the user. Assembly of the display 11 will be more fully described in the text to follow. Hand holds 30 are cutout in each end column 14 and 15 as shown in FIGS. 3A through 3D for ease of assembly and carrying. The hand holds 30 are hidden from the viewer by the center wall 22 when the display 11 is fully assembled. Each individual end column segment 34*a, b*, and *c* has rib tabs 33 as shown in FIG. 3B, 3C, and 3D. Each rib tab 33 on each end column segment 34*a*, 34*b*, and 34*c* is separated from the other rib tab 33 on the same segment by an end column notch 18. The end column notch 18 forms a sixty degree angle with its apex located at the intersection of the rib tab 33 fold lines and the central fold line of each end column segment 34*a*, 34*b*, and 34*c*. The end 53 of each rib tab 33 on each end column segment 34*a*, 34*b*, and 34*c* is die cut at a thirty degree angle. The notch 18 and the end of the rib tab 53 allows the ribs 32 to abut one another, and in the case of the rib tab end 53 to abut the inside of the wall of the end column, when the end column is assembled as shown in FIGS. 7A, 7B, and 7C and provides added rigidity to each end column 14 and 15.

Figure 6A:
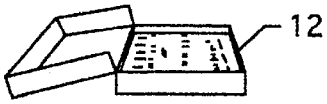
FIGS. 6A through 6D are perspective views of a display in various stages of assembly.
Figure 6B:
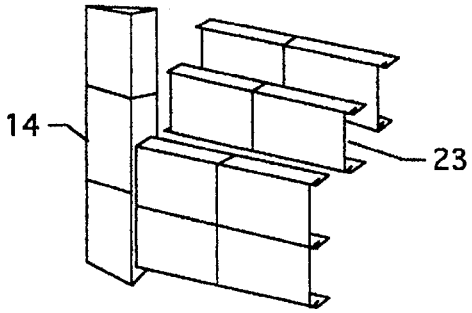
Figure 6C:
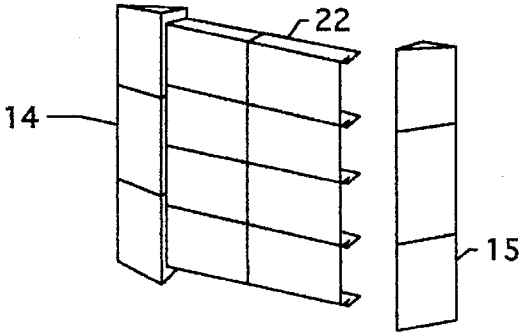
Figure 6D:
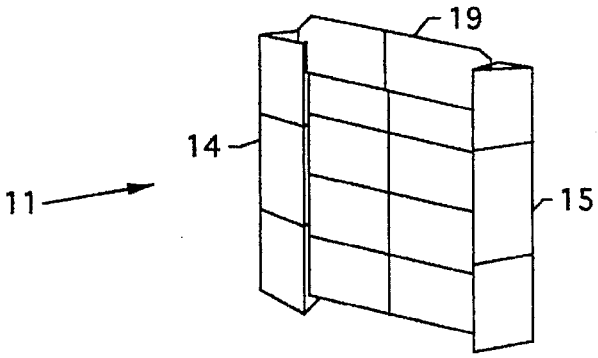
Figure 7A:
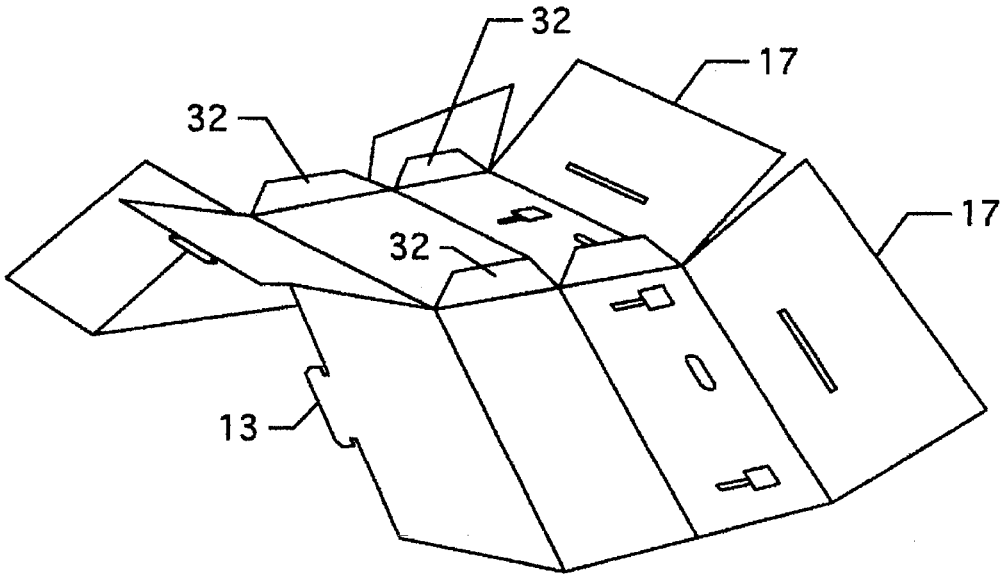
FIGS. 7A, 7B, and 7C are perspective views.
Figure 7B:
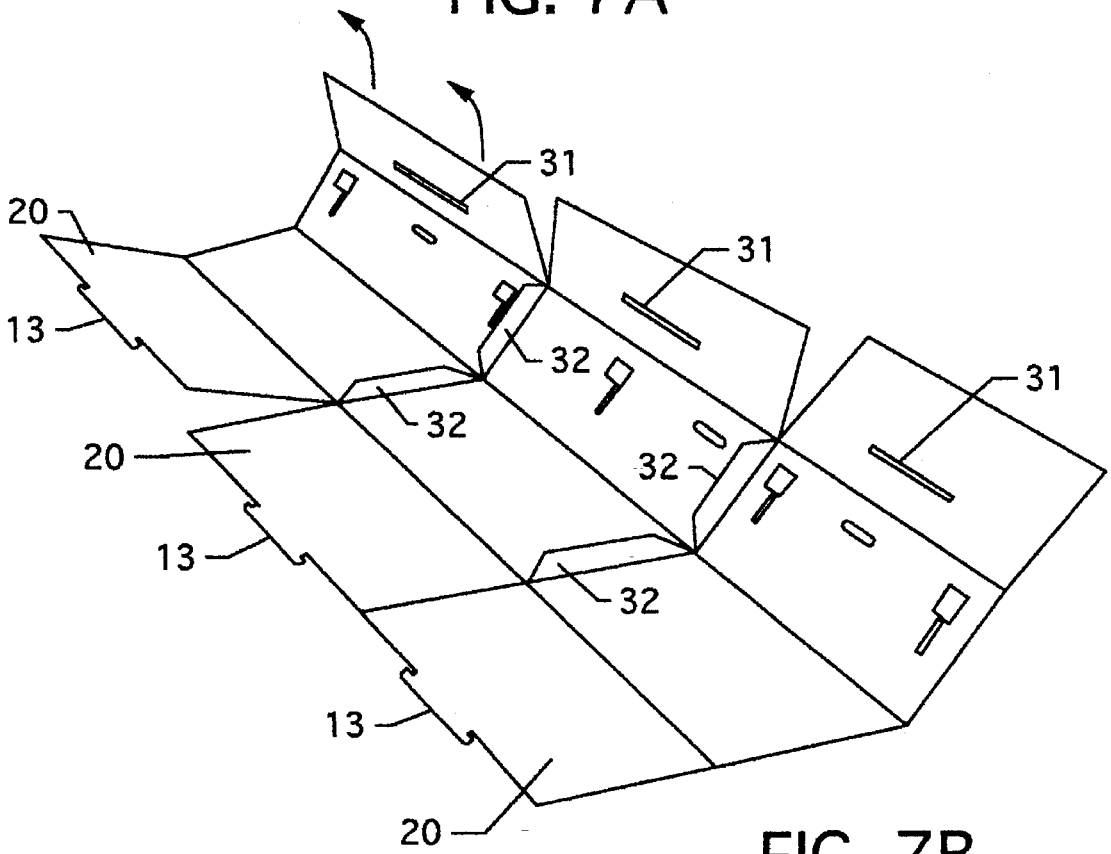
Figure 7C:
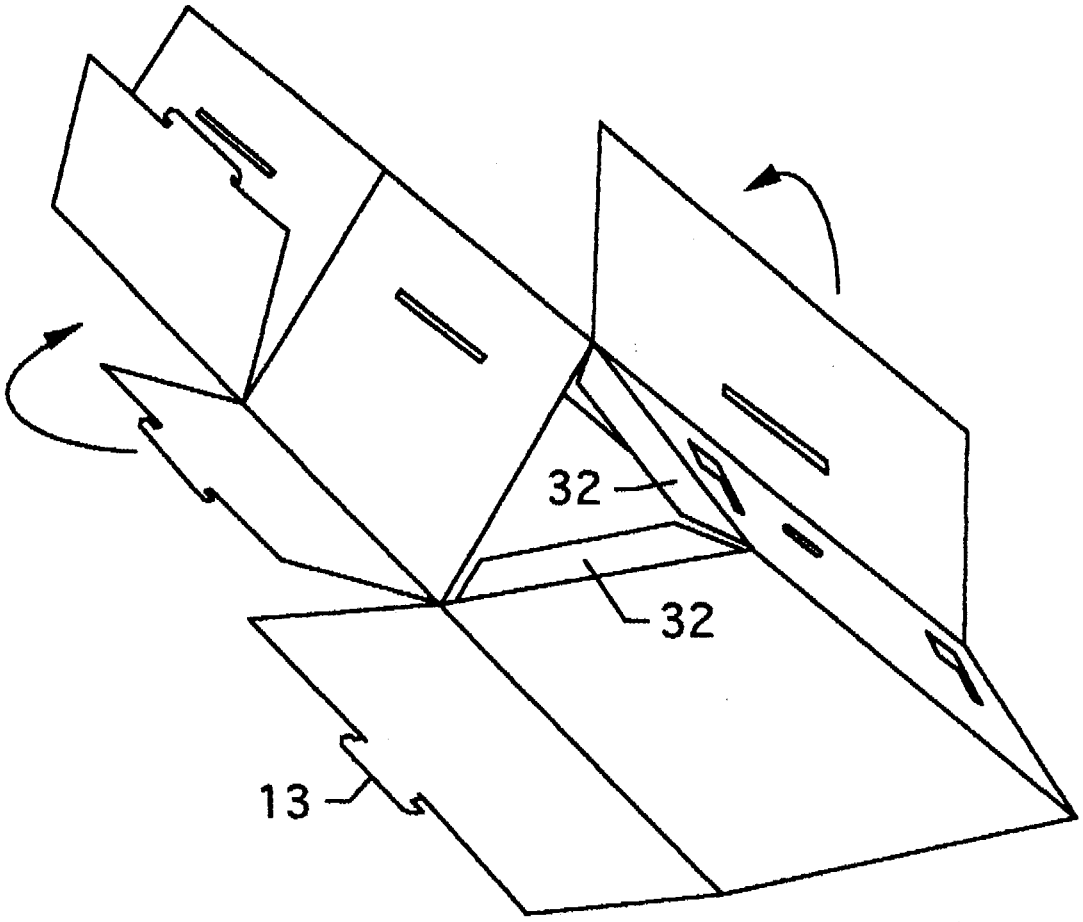

FIGS. 7A, 7B, and 7C illustrate the assembly steps of an end column 14 or 15. Beginning with FIG. 7A, a folded end column 14 or 15 is taken from its point of sale container 12, shown in FIG. 6A, and unfolded on a clean floor with the finish side, or exterior side, of the end column 14 or 15 towards the floor. In FIG. 7B, slotted panels 17 are rolled over along longitudinal fold lines and tucked under tabbed panels 20. Tabs 13 are inserted into slots 31 to form a rigid column, as shown in FIG. 7C.

Figure 20A:
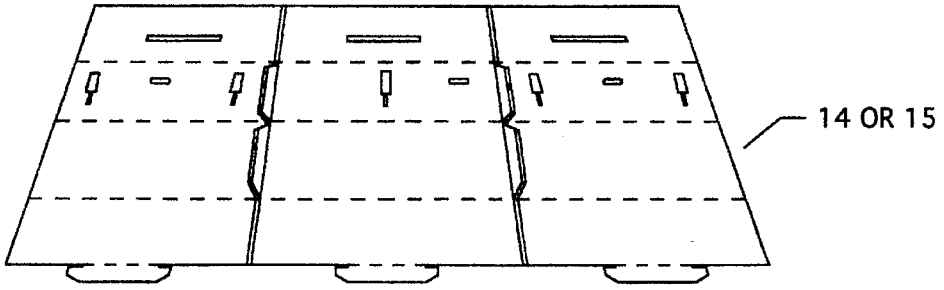
FIGS. 20A through 20E are perspective views showing various stages of refolding an end column for placement in the point of sale container.
Figure 20B:
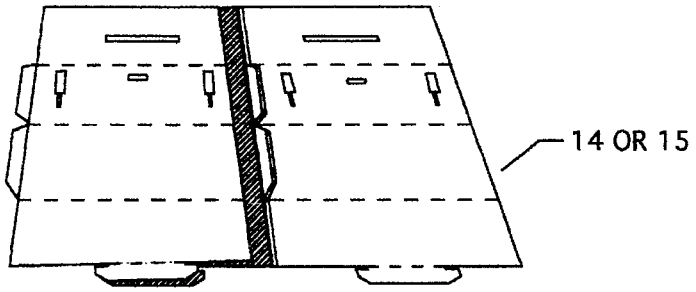
Figure 20C:
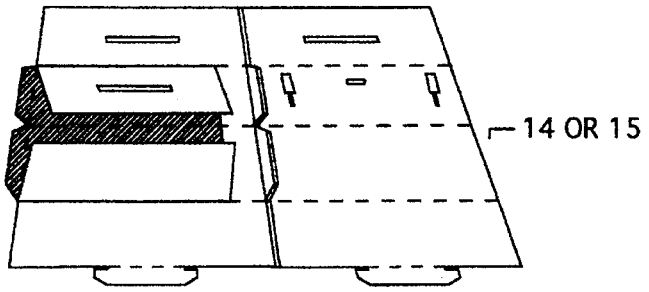
Figure 20D:
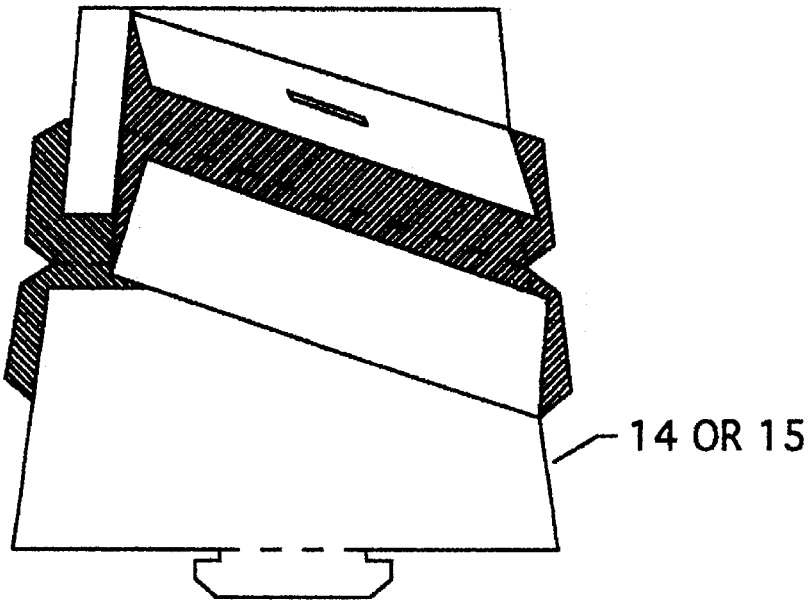
Figure 20E:
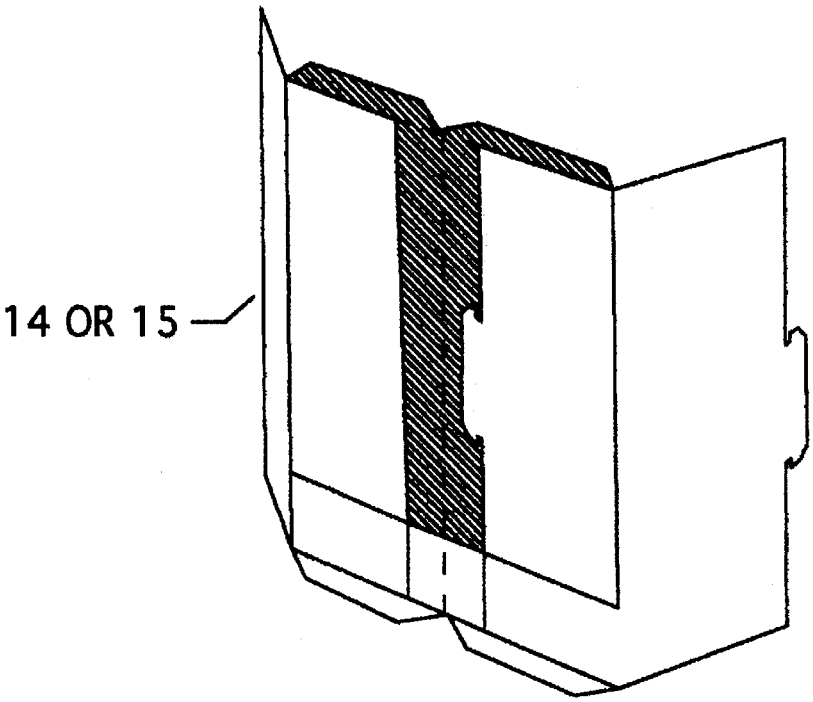

FIGS. 7A, B, and C each illustrate end column ribs 32 formed during manufacture by folding rib tabs 33, as shown in FIG. 3, along preformed crease lines perpendicular to the inner face of an end column, 14 or 15. Adjacent end column segments 34*a*, 34*b*, and 34*c* are placed in abutting engagement and the rib tabs 33 are glued together to form ribs 32. After the rib tabs 33 are glued to form ribs 32 and a unitary end column 14 or 15, each end column is folded as shown in FIGS. 20A through 20E for shipment in its point of sale container 12. FIG. 20A shows an end column 14 or 15 on the floor with the finish side up and the ribs 32 down. The end column is folded beginning with FIG. 20B and ending with FIG. 20E in accordance with the arrows shown in the figures.

Figure 4:
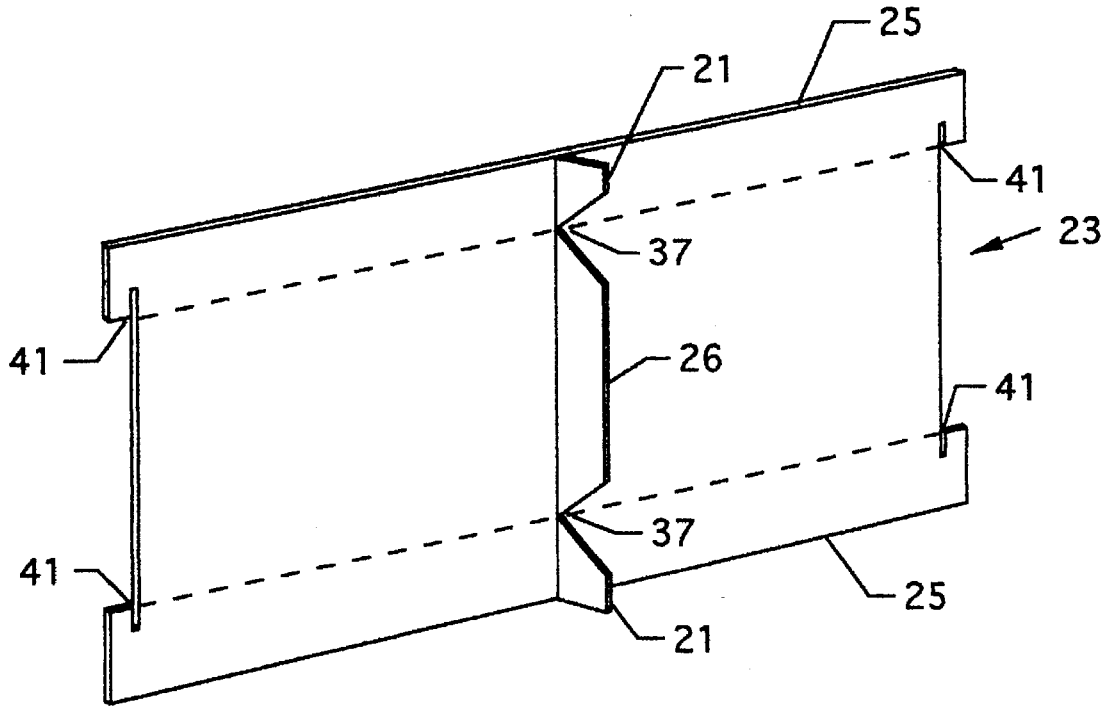
FIG. 4A is a plan view of an unfolded center section.
Figure 13:
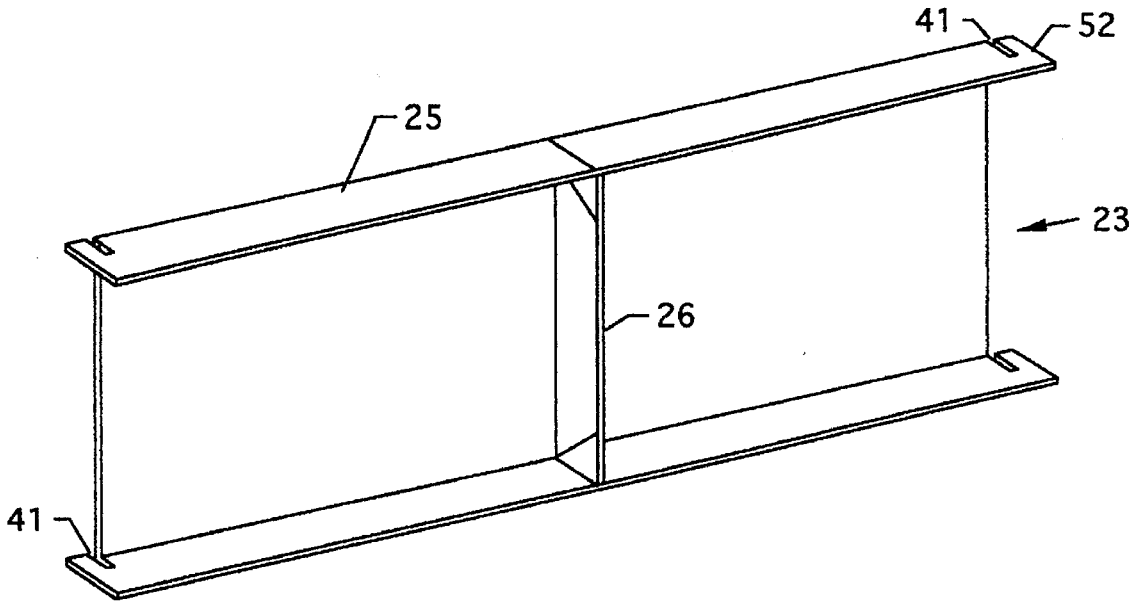
FIG. 13 is a perspective view of the back of a center wall section fully assembled.

FIG. 11 shows a center wall section panel 36 and also is a plan view of a center wall section 23 folded for packing in a point of sale container 12. The center wall 22 is comprised of three center wall sections 23. Each center wall section 23 consists of two identical panels 36*a* and 36*b* glued together at the point of manufacture along the opposing insides of each of the center wall vertical rib tabs 38 as shown in FIG. 12. The center wall vertical and horizontal rib tabs have a notch 37. Notch 37 is formed by a cutout portion defined by a 90 degree angle having as its apex the intersection of the vertical and horizontal fold lines as shown in FIG. 11. Each center wall section 23 has two horizontal ribs 25. Each horizontal rib 25 engages with a vertical rib 26 as the center section 23 is unfolded and assembled as shown in FIGS. 12, 4, and 13; thereby providing a strong form fitting construction. FIG. 13 illustrates a completely assembled center section 23 as viewed from the back. FIG. 12 shows a partially unfolded center section 23. FIG. 4 shows a completely unfolded center section 23. Each center wall section panel 36*a* and 36*b*, has elongated notches 41 in that portion of the center wall horizontal rib tabs 39, which extend beyond the vertical ends of the center wall section panels 36*a* and 36*b*. The elongated notches 41 are disposed perpendicular to a fold line as shown in FIG. 11. The elongated notches 41 engage with center wall slots 28 on the end columns 14 and 15 when the display is assembled. The elongated notch 41 width is slightly less than the thickness of the corrugated material out of which the display 11 is constructed.

Figure 5A:
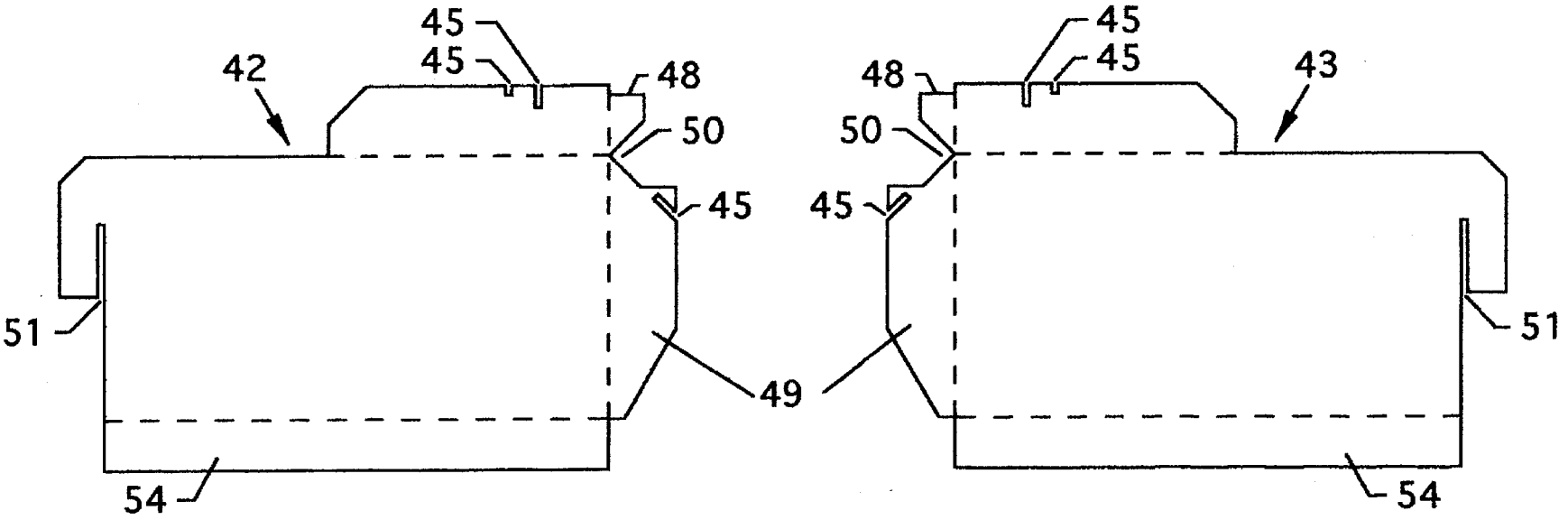
FIG. 5A is a perspective view of the back of a first and second panel of an unassembled header. 5B is a perspective view of the back of the header with the first and second panels glued together, and 5C is a perspective view of an assembled header panel.
Figure 5B:
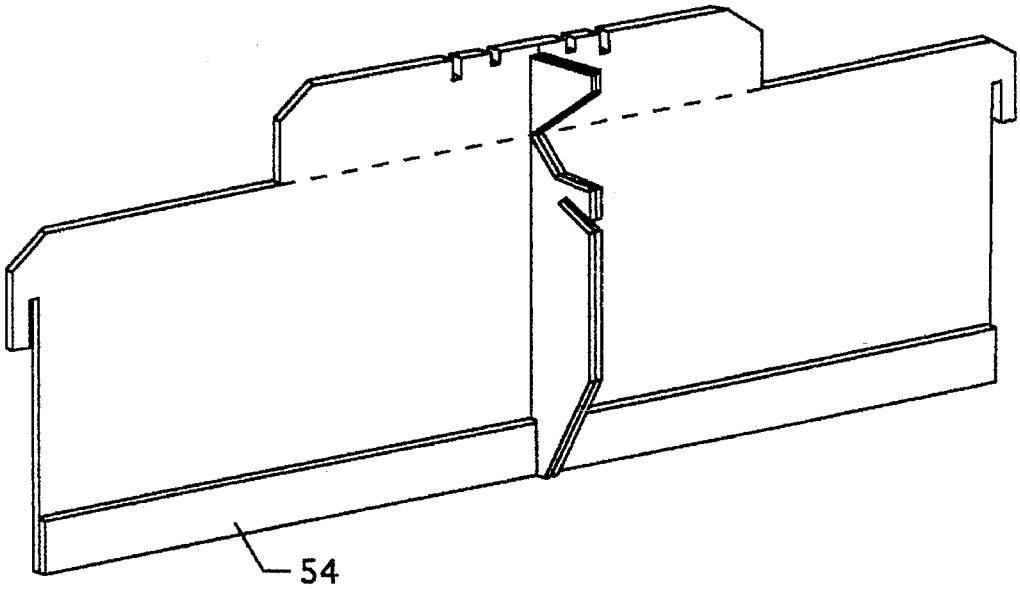
Figure 5C:
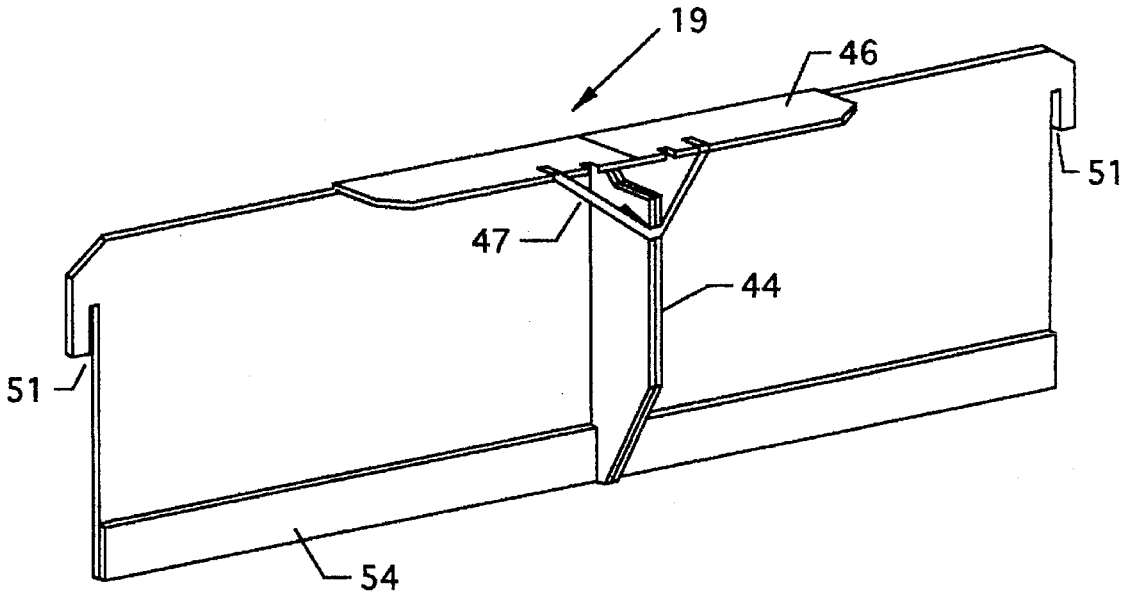

The header 19, as shown in assembled form from the back in FIG. 5C, serves as a part of the display area and as a lateral support member. The display area on the front of the header 19 is especially adaptable for placement of a banner indicating the name of the trade show participant. FIG. 5A shows a first and second header panel 42 and 43 in a flat unassembled condition. FIG. 5B shows the two panels glued together along the opposing inside faces of the header vertical rib 44. An elastic band 47 is connected through slits 45 on the vertical rib 44 and horizontal rib 46 at the point of manufacture. When the header 19 is unfolded as shown in FIG. 5B, the horizontal rib 46 is pulled towards the vertical rib 44 by the stretched elastic band 47 resulting in engagement of the upper part of the vertical rib 48 and the lower part of the vertical rib 49. The upper part of the vertical rib 48 is separated from the lower part 49 by a wedge shaped cut-out 50 as shown in FIG. 5A. The wedge shaped cut-out 50 is formed by a 90 degree angle having its apex located on the intersection of the fold line of the header horizontal rib 46 and the header vertical rib 44, as shown in FIG. 5A. Upon full closure of the upper part of the vertical rib 48 and the lower part of the verticle rib 49 when in a fully assembled state the header 19 is as shown in FIG. 5C. The horizontal rib 46 is stopped from opening further than a 90 degree angle with respect to the back of the header 19 by the engagement of the upper and lower parts of the vertical rib 48 and 49, respectively. The header 19 at each of its vertical end surfaces when in a fully assembled state has die cut header slots 51 as shown in FIGS. 5A, B, and C, the purpose of which will be explained herein in connection with the instructions for assembly of the display 11. The header slot 51 width is slightly less than the thickness of the corrugated material out of which the end columns 14 and 15 are constructed. A reinforcement doubler 54 overlays the bottom portion of the header 19. The doubler 54 is added at the point of manufacture by folding the bottom portion of the header panels 42 and 43 along the fold line and glueing the doubler 54 to the header panels 42 and 43.

Figure 8:
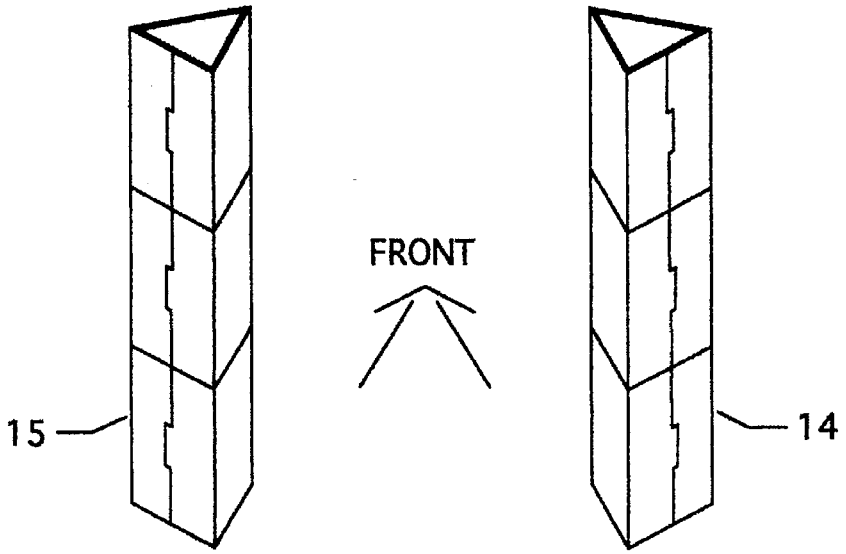
FIG. 8 is a perspective view of two assembled end columns showing their position relative to one another in a fully assembled display.
Figure 9:
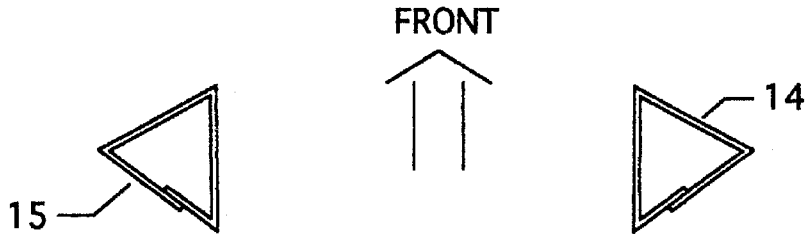
FIG. 9 is a plan view of two assembled end columns showing their position relative to one another in a fully assembled display.

The overall process of assembling the display assembly 11 is now described and is shown generally in FIG. 6A through 6D. Assembly starts with opening the point of sale container 12, unfolding the various corregated sections contained in the box, and assembling the two end columns 14 and 15, the three center sections 23, and the header 19. These steps have previously been described. The next step is to place the two end columns 14 and 15 on end as shown in FIG. 8, which is a view of the end columns 14 and 15 from their back side. One of the end columns is placed with its locking doors 29 pointing upward and the other with its locking doors 29 facing downward as shown in FIG. 8. FIG. 9 is a plan view of the end columns placed as shown in FIG. 8.

Figure 15:
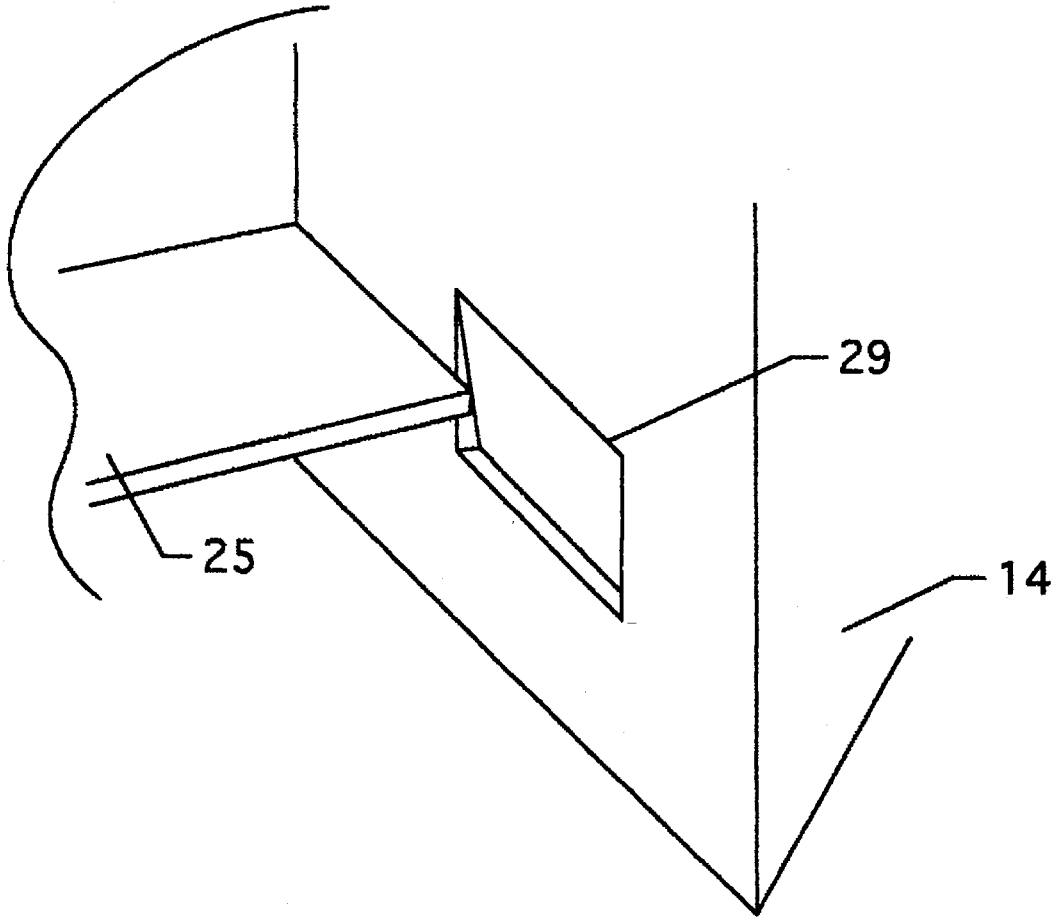
FIG. 15 is a perspective view of a center section end tab and center wall slot fully engaged.

The next step consists of inserting all the center sections 23 into one end column 14 as shown in FIG. 14, which is a view of the display 11 from its back side. It is important to not insert the opposing side of the center sections 23 into the second end column 15 until all the center sections 23 are inserted into the first end column 14. Insertion of the center sections 23 is accomplished by first depressing the locking doors 29 towards the center of the end column 14 or 15 and then inserting the center section end tabs 52 as shown in FIG. 14 into the locking door 29 opening and the end column slot 31. The center section 23 is then slid forward, engaging the end column 14 wall in the center section end tabs 52, flush with the locking door 29 opening, thereby allowing the locking door 29 to swing back to its original closed position to lock the center wall 22 in place. A detail of the center section end tab 52 inserted into one of the center wall slots 28 is shown in FIG. 15.

Figure 16:
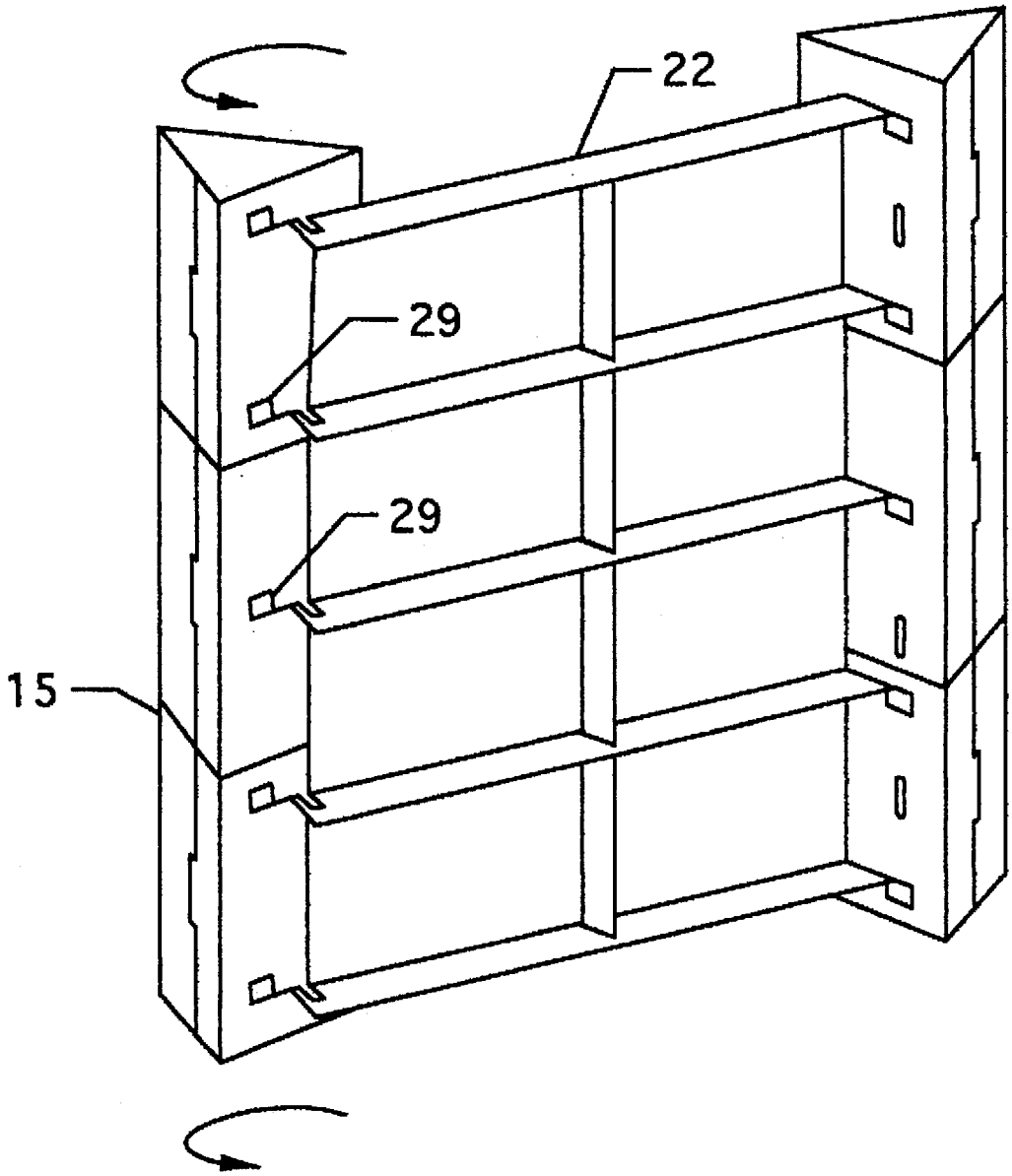
FIG. 16 is a perspective view showing assembly of a second end column to the center wall.
Figure 17:
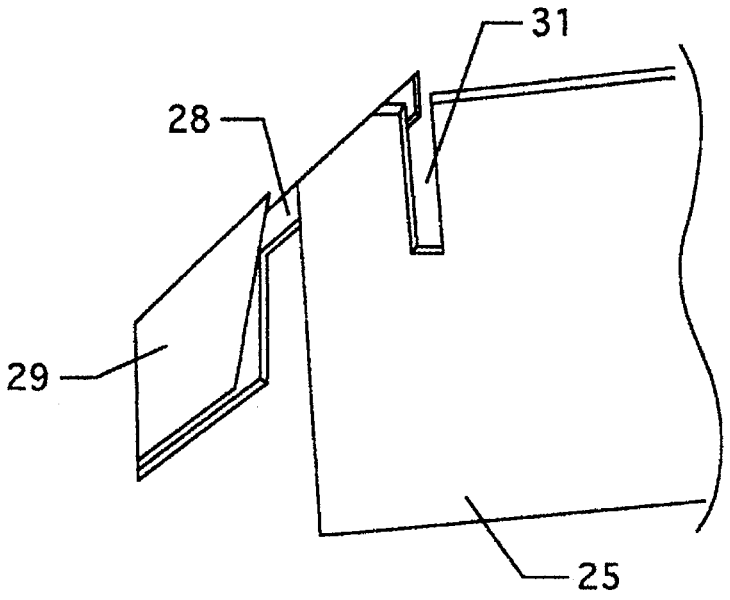
FIG. 17 is a perspective view showing partial engagement of a center section end tab and a center wall slot during assembly of a second end column to the center wall.

Upon completion of insertion of each center section 23 into the first end column 14, the second end column 15 is positioned at an angle to and slightly ahead of the center wall 22 as shown in FIG. 16, which is a view from the back of the display 11. The center section end tabs 52 are partially inserted into the center wall slots 28 as shown in more detail in FIG. 17. After all the center section end tabs 52 have been inserted into the center wall slots 28, the second end column 15 is rotated backward in the direction of the arrows in FIG. 16 completing insertion of the center section end tabs 52 as rotation is completed. After the tabs 52 are fully inserted, the center wall 22 is slid forward to lock the center section end tabs 52 in place with the locking doors 29.

Figure 18:
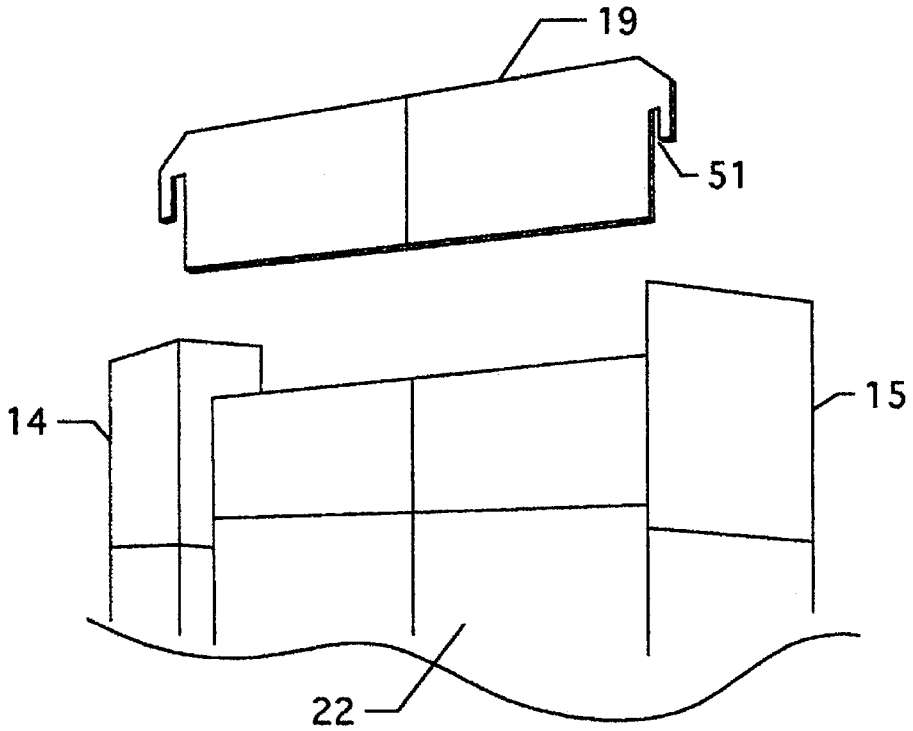
FIG. 18 is a perspective view showing the first stage of assembly of the header to the end columns.
Figure 19:
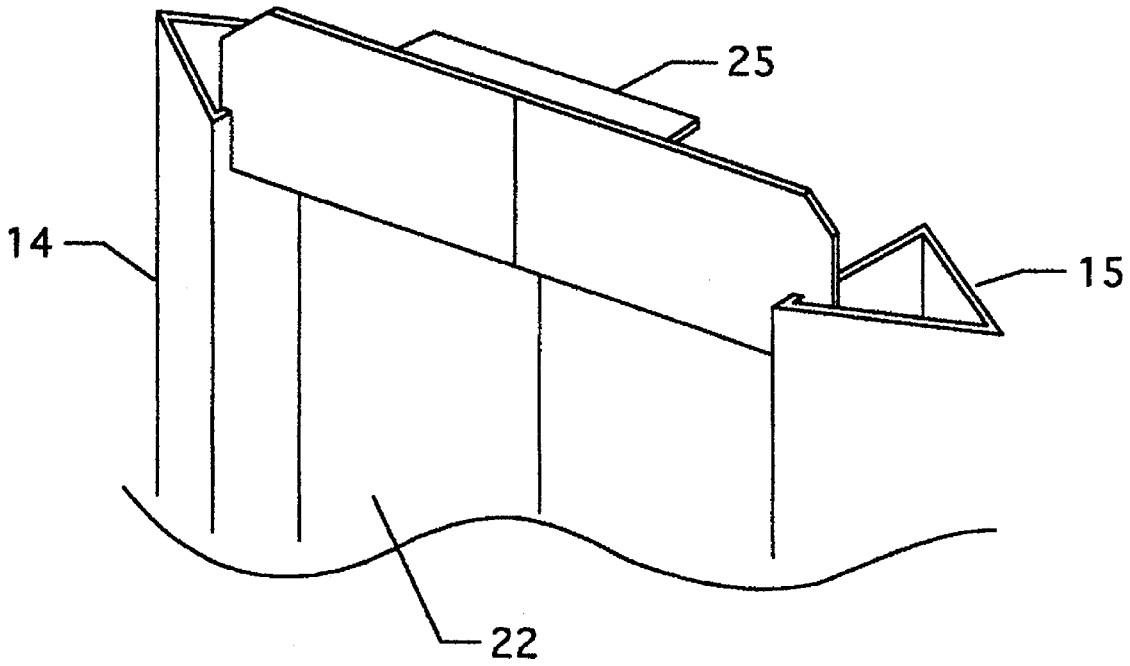
FIG. 19 is a perspective view showing the second stage of assembly of the header to the end columns.

The fully assembled header 19 is attached to the end columns 14 and 15 as shown in FIGS. 18 and 19 The header slots 51 are slid onto the end columns 14 and 15 and header slots 51 mate with the wall of the end columns 14 and 15. The header 19 is then pulled forward on the end columns 14 and 15 as far as possible. Finally, one or both of the end columns 14 or 15 is rotated toward the center to pinch the header 19 in place.

The present invention may be embodied in other specific forms without departing from the spirit or essential attributes thereof, and it is therefore desired that the present embodiment be considered in all respects as illustrative and not restrictive, reference being made to the appended claims rather than to the forgoing description to indicate the scope of the invention.

What is claimed is:

1. A display assembly comprising:

a. a first end column;

b. a second end column;

c. a center wall disposed between the first and second end columns; and d. a header disposed between the first and second end columns and proximate to an upper portion of the center wall;

wherein the end columns are connected to the center wall by insertion of a center wall end tab into a corresponding column locking door defined by a slit along a periphery of the locking door.

2. The display assembly of claim 1, wherein the center wall end tab is formed with a slot and a portion of the periphery of the locking door defined by the slit is located adjacent to and communicating with the center wall end tab slot, so that when the center wall end tab slot is fully inserted into the locking door slit, the end column wall is flush with the locking door opening.

3. A connector for connecting corrugated paper members, comprising:

a. locking door in the surface of a first corrugated paper member;

b. a slot in the surface of the first corrugated paper member in communication with the opening of the locking door, and;

c. an end tab positioned on an end of a second corrugated paper member, the end tab having an elongated notch therein, whereby upon insertion of the end tab of the second corrugated paper member into the slot of the first corrugated paper member and sliding the elongated notch of the second corrugated paper member away from the locking door along the slot until it is flush with the opening of the locking door, the locking door moves to a closed position and secures the two corrugated paper members together.

4. A display assembly comprising:

a. a first end column;

b. a second end column;

c. a center wall disposed between the first and second end columns; and d. a header disposed between the first and second end columns and proximate to an upper portion of the center wall, the header having a lower part of a vertical rib and an upper part of a vertical rib, the upper and lower parts of the vertical rib being separated from one another by a wedge shaped cut out.

5. The display assembly of claim 4, wherein the header is comprised of a first and second header panel:

a. each header panel having (I) a lower part of a vertical rib and an upper part of a vertical rib, the upper and lower parts of the vertical rib being separated from one another by a wedge shaped cut-out, (ii) a horizontal rib, and (iii) a header slot;

b. each header panel adhesively connected along corresponding surfaces of the header vertical ribs; and c. the horizontal rib of each header panel held in a position of ninety degrees to the header panel by a bias means.

6. The display assembly of claim 5, wherein the bias means is elastic.

7. The display assembly of claim 6, wherein the elastic bias means is connected from a slit in the horizontal rib of a first header panel, to a slit in the vertical rib, and to a slit in the horizontal rib of a second header panel.

8. The display assembly of claim 4, wherein the header is connected to the end columns by engagement of vertically disposed header slots, located proximate to opposed vertical ends of the header, with corresponding side walls of the end columns.

9. The display assembly of claim 4, wherein the header has a horizontal rib.

10. A display assembly comprising as members:

a. a first end column;

b. a second end column;

c. a center wall disposed between the first and second end columns; and d. a header disposed between the first and second end columns and proximate to an upper portion of the center wall;

wherein interconnection of the members to form the assembly is solely by fasteners or connectors formed integral to and part of each member; and wherein the assembly is free-standing.

11. The display assembly of claim 10, wherein the display assembly is constructed of corrugated paper.

12. The display assembly of claim 10, wherein at least one end column member is a hollow tube.

13. The display assembly of claim 10, wherein at least one end column member has a triangular cross-section.

14. The display assembly of claim 10, wherein the center wall member is constructed of center wall sections.

15. The display assembly of claim 14, wherein the center wall member is comprised of:

a) a panel section;

b) a horizontal rib section;

c) a vertical rib; and d) center section end tabs located on the upper and lower portions of each end of the center section.

16. The display assembly of claim 15, wherein each center section end tab is formed by a portion of the horizontal rib that extends beyond the panel section, said center section end tab defining an open ended notch having its open end oriented in a direction towards a front of the center panel when the horizontal rib is folded into an assembled position.

17. The display assembly of claim 10, wherein the end column is comprised of:

a) a hollow tube; and b) at least one rib along a portion of a periphery of an internal wall of the tube.

18. The display assembly of claim 10, wherein an unassembled corrugated paper end column has longitudinal fold lines so that upon folding along the fold lines, sides of the end column are formed.

19. The display assembly of claim 17, wherein the end column is comprised of at least two end column sections.

20. The display assembly of claim 19, wherein each end column section has an end column rib tab, the rib tab on one section adjacent the rib tab on an adjoining section for abutting engagement when the rib tabs are folded towards a center of the end column section and ninety degrees to the end column section walls.

21. The display assembly of claim 11, wherein the display is convertible between a flat, knocked-down configuration and an assembled configuration.

22. The display assembly of claim 21, wherein the display is repeatedly convertible between a flat, knocked-down configuration and an assembled configuration.

* * * * *